US006112464A

United States Patent [19]

Grisham et al.

[11] Patent Number: 6,112,464

[45] Date of Patent: Sep. 5, 2000

[54] BRACKET FOR COUNTERBALANCED GARAGE DOOR

[75] Inventors: James L. Grisham, Denison; David Scott Boucher, Rowlett, both of Tex.

[73] Assignee: Overhead Door Corporation, Dallas, Tex.

[21] Appl. No.: 08/789,783

[22] Filed: Jan. 29, 1997

[51] Int. Cl.[7] ..... E05F 11/04

[52] U.S. Cl. ..... 49/199; 160/199; 160/200

[58] Field of Search ..... 49/199, 200, 425; 160/191, 193, 201, 207, 188

[56] References Cited

U.S. PATENT DOCUMENTS

| | | | |
|---|---|---|---|
| 1,724,995 | 8/1929 | Dautrick . | |
| 2,093,020 | 9/1937 | Norberg | 20/20 |
| 2,525,309 | 10/1950 | Norberg | 16/97 |
| 2,694,214 | 11/1954 | Hammer | 16/97 |
| 2,703,141 | 3/1955 | McKee | 16/97 |
| 3,160,200 | 12/1964 | McKee et al. | 160/189 |
| 3,412,780 | 11/1968 | Moler | 160/191 |
| 5,053,263 | 10/1991 | Bies | 49/489.1 |
| 5,103,890 | 4/1992 | Cloutier | 160/190 |
| 5,353,473 | 10/1994 | Sherick | 16/97 |
| 5,404,927 | 4/1995 | Bailey | 160/201 |
| 5,495,640 | 3/1996 | Mullet et al. | 16/97 |

*Primary Examiner*—Daniel P. Stodola
*Assistant Examiner*—Curtis A. Cohen
*Attorney, Agent, or Firm*—Akin, Gump, Strauss, Hauer & Feld, LLP

[57] ABSTRACT

An upward acting sectional door formed of rectangular door sections which are interconnected to form a closure over a door opening. Opposed somewhat L-shaped bottom brackets are secured to opposed lower side edges of the bottom door section by fasteners which are not easily accessible for removal when the door is assembled and disposed between adjacent guide tracks. Opposed guide rollers connected to counterbalance cables are partially supported by the brackets and transfer upward lifting forces to the door through the brackets.

11 Claims, 5 Drawing Sheets

BRACKET FOR COUNTERBALANCED GARAGE DOOR

FIELD OF THE INVENTION

The present invention pertains to a sectional, upward acting door, such as a garage door, including brackets for reinforcing the lower corner edges of the door and for transferring forces exerted by door counterbalance cables to the door structure.

BACKGROUND

Upward acting or vertical opening sectional doors are ubiquitous as residential garage doors and are also widely used in commercial door applications. As part of a continuing need to provide improvements in sectional doors of the general type referenced herein, one pressing need has been to reduce the weight of the door while not sacrificing strength and rigidity and to provide a suitable secure closure over the door opening, such as a garage vehicle entry. In this regard, extrudable or moldable polymer materials have been given consideration for use in the main structural members of sectional garage doors and the like.

A problem associated with providing lightweight doors constructed of polymer materials has been the provision of suitable brackets and reinforcing members for transferring loads from counterbalance cables to the door structure itself. Moreover, such brackets, if connected to counterbalance cables, should be arranged in a way to minimize inadvertent disconnection of the bracket when the counterbalance cable is under tension to minimize the chance of injury, damage to the door structure and/or damage to the counterbalance mechanism.

Accordingly, with respect to doors manufactured of lightweight polymer materials, in particular, there has been a need to provide an improved bracket arrangement for connecting the counterbalance cable to the lower corner of the lower door section, which bracket is constructed and secured to the door in such a way as to minimize unwanted disconnection of the bracket. There has also been a need to provide a bracket which is further constructed in such a way as to assist in transferring forces exerted by counterbalance or operating cables to the door structure without imposing damaging stresses on the door structure. It is to these ends that the present invention has been developed.

SUMMARY OF THE INVENTION

The present invention provides an improved sectional, upward acting door and a support bracket for such a door which meets the desiderata mentioned hereinabove.

In accordance with one important aspect of the invention, a support bracket is provided for an upward acting door wherein the point of attachment of a counterbalance or operating cable to the door is arranged in such a way as to minimize unwanted disconnection of the cable. In this respect, a support bracket is provided which is disposed at the intersection of each of the opposed bottom and side edges of the door, respectively, and arranged such that each bracket and a counterbalance cable, which is transferring forces thereto, may not be removed without purposely reducing tension on the cables and removing the door at least partially from opposed door guide tracks and then removing a door guide member and associated support shaft therefor. The arrangement provides for minimizing unwanted disconnection of the bracket and a counterbalance or operating cable from the door.

In accordance with another aspect of the invention, a door bottom bracket is provided for an upward acting door which is particularly adapted for transferring door counterbalance or operating forces to the door structure while minimizing the concentration of stresses or forces acting on the door structure.

Those skilled in the art will further appreciate the important features of the invention upon reading the detailed description which follows in conjunction with the drawing.

DESCRIPTION OF A PREFERRED EMBODIMENT

Figure 1:
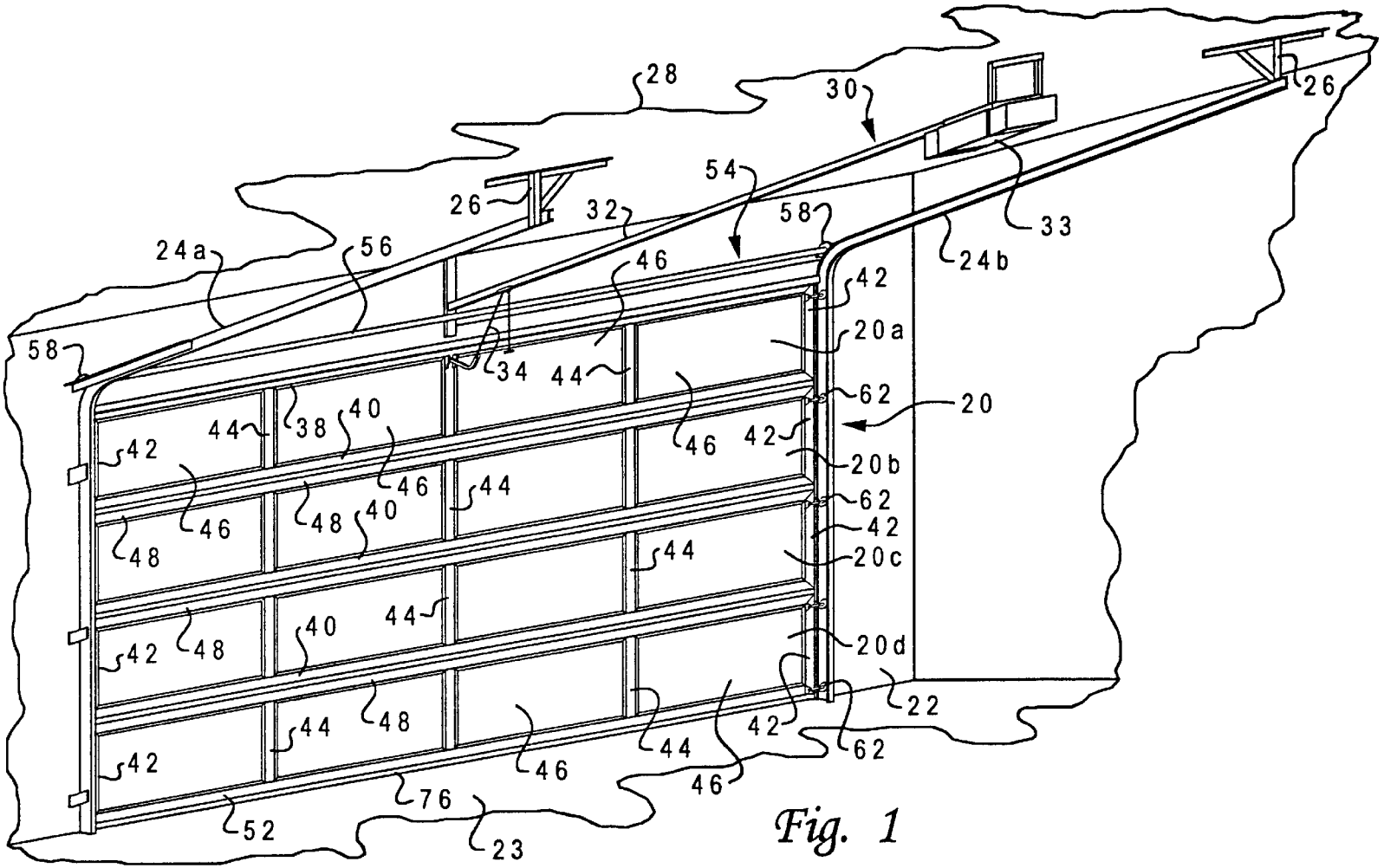
FIG. 1 is a perspective view of a sectional, upward acting garage door in accordance with the present invention.

In the description which follows like parts are marked throughout the specification and drawing with the same reference numerals, respectively. The drawing figures are not necessarily to scale and certain elements may be shown in schematic or generalized form or omitted from certain views in the interest of clarity and conciseness.

Referring to FIG. 1, a sectional, upward acting door in accordance with the present invention is illustrated and generally designated by the numeral 20. The door 20 is illustrated as a double width sectional garage door adapted to close over a vehicle entry opening formed in a vertical wall 22, for example. The door 20 is supported for movement between open and closed positions on spaced apart opposed guide tracks 24*a* and 24*b* of conventional construction, which tracks are supported at wall 22 in a conventional manner and also by support brackets 26 depending from a garage ceiling 28. The door 20 is operable to be moved between open and closed positions by a motor driven operator mechanism of conventional design and generally designated by the numeral 30. The operator mechanism 30 includes a linear traversal device such as a rotating screw or roller chain, not shown, and supported on a beam 32 extending between an operator motor unit 33 and the wall 22. An arm 34 is operable to interconnect the motor driven operator mechanism 30, including the aforementioned device, and the door 20. The arm 34 may be of conventional design and be connected to the operator mechanism in a conventional manner.

The door 20 is shown in a closed position in FIG. 1 covering the aforementioned opening in wall 22 and extending across the opening with its lower edge directly adjacent a floor 23. The door 20, in the embodiment shown, comprises four interconnected sections 20*a*, 20*b*, 20*c* and 20*d* which are connected by suitable hinge means, not shown.

Referring further to FIG. 1, the door section 20*a* is characterized by an elongated top rail member 38, and a generally parallel and coextensive lower rail member 40 spaced from the top rail. The top and lower rail members 38 and 40 are interconnected by spaced apart vertical end stiles 42. Intermediate vertical stiles 44 also extend between the rail members 38 and 40. The rail members 38 and 40 and the stiles 42 and 44 support planar panel inserts 46.

Door sections 20*b* and 20*c* are identical and are each characterized by a longitudinal upper rail member 48, a longitudinal lower rail member 40, opposed vertical end stiles 42 and intermediate stiles 44 which also support panel inserts 46 therebetween in the same manner as for the section 20*a*. Bottom section 20*d* is characterized by an elongated upper rail 48, and a lower, generally parallel longitudinal bottom rail member 52 spaced therefrom. The rail members 48 and 52 are also interconnected by end stiles 42 and by intermediate stiles 44 which, in combination with the rails 48 and 52, support panel inserts 46.

Figure 2:
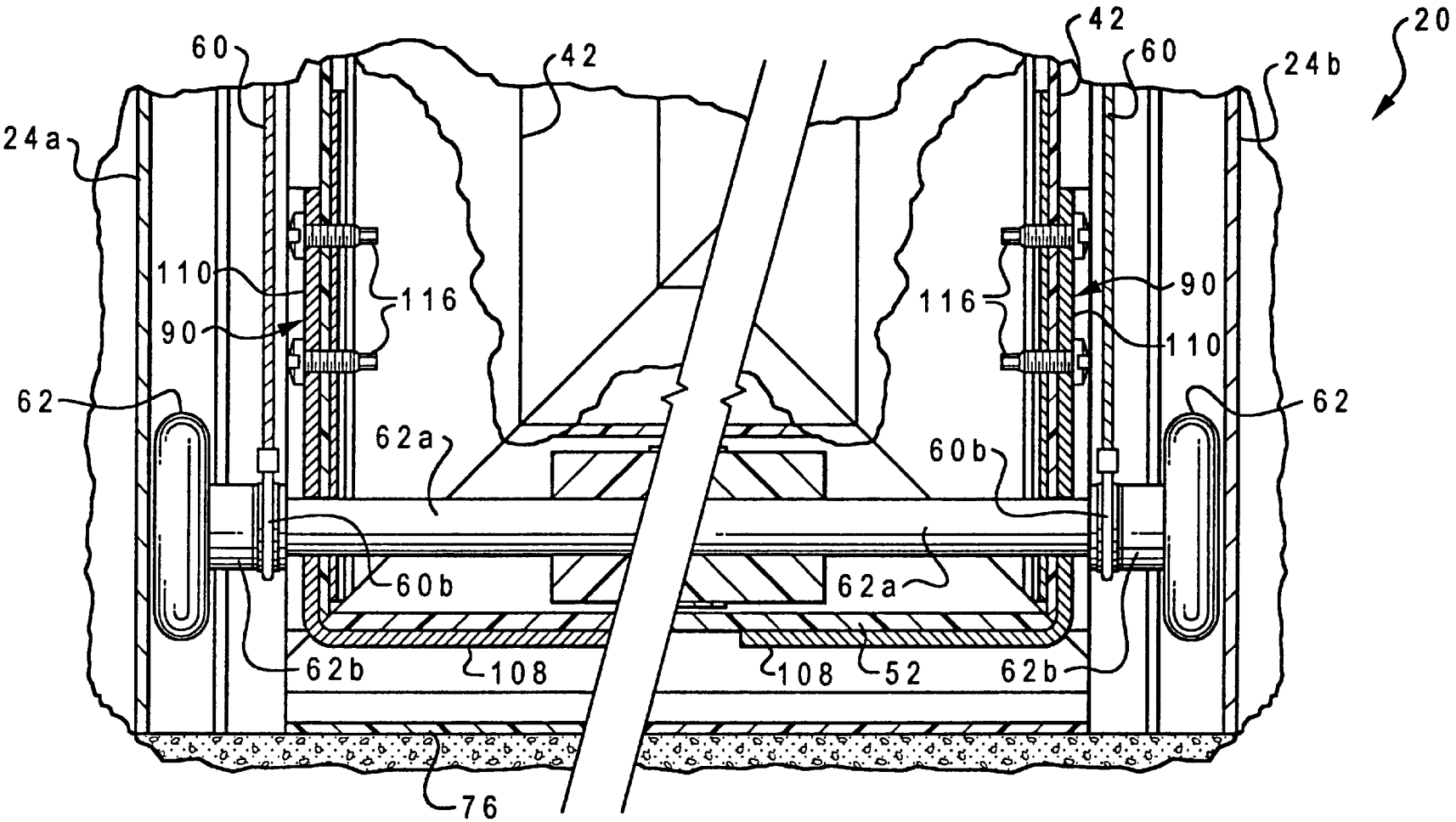
FIG. 2 is a detail partial elevation, partially sectioned, showing the support brackets at the opposite lower corners of the door shown in FIG. 1.

The door 20 is also adapted to be counterbalanced by a conventional counterbalance mechanism, generally designated by the numeral 54, including a counterbalance shaft 56 having opposed cable drums 58 supported thereon for rotation to pay out or reel in opposed counterbalance cables 60, see FIG. 2. As further shown in FIG. 2, the cables 60 are connected at their lower ends to the door 20 by way of respective guide rollers 62 suitably connected to the bottom section 20*d* in a manner to be described in further detail herein. The counterbalance mechanism 54 may be of a conventional configuration wherein one or more torsion springs, not shown, are operable to bias the shaft 56 to rotate in a direction which exerts an upward acting force on the door 20 through the cables 60 to counterbalance at least a significant portion of the weight of the door.

Figure 3:
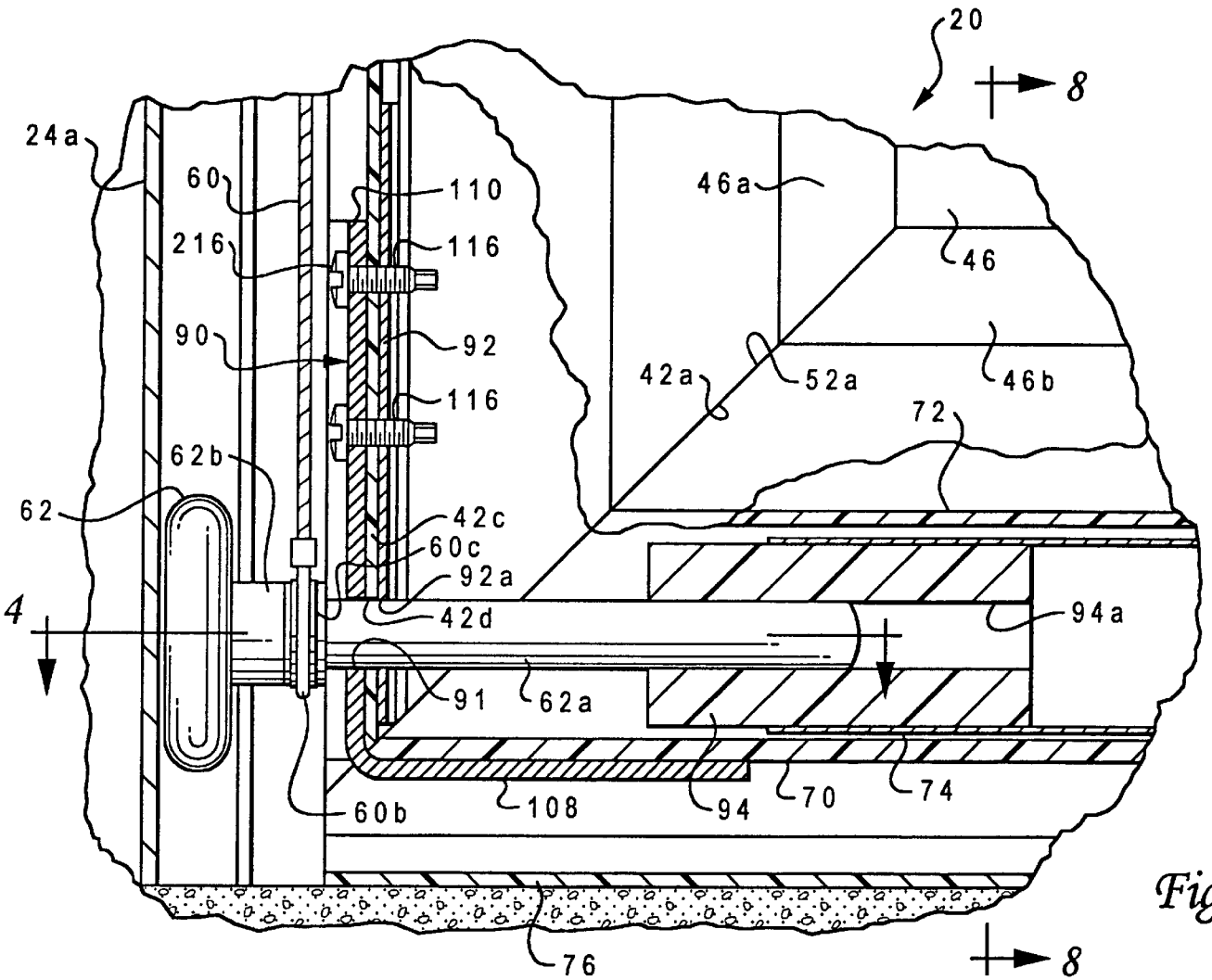
FIG. 3 is a detail section view of one of the brackets shown in FIG. 2 on a larger scale.

The components of the door sections including the rail members 38, 40, 48 and 52, together with the stiles 42 and 44, are preferably formed of a suitable all-weather grade of a vinyl polymer, for example, and preferably formed as hollow extrusions, respectively. As shown in FIGS. 2 and 3, the stiles 42 and the bottom rail 52 are interconnected at mitered edges 42*a* and 52*a*, preferably by thermal or chemical bonding for example. The panel inserts 46 are also preferably formed of a suitable plastic such as a vinyl polymer and are retained in their working positions by suitable retainer means 46*a* and 46*b*, FIG. 3.

Figure 4:
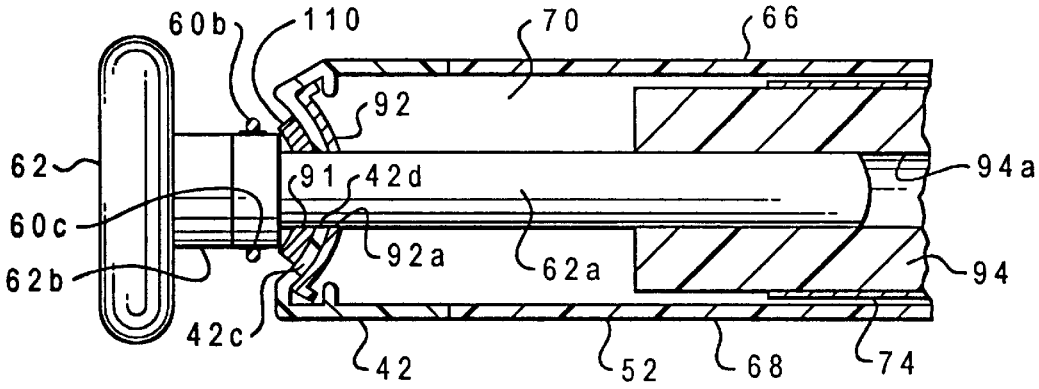
FIG. 4 is a section view taken along the line 4—4 of FIG. 3.
Figure 8:
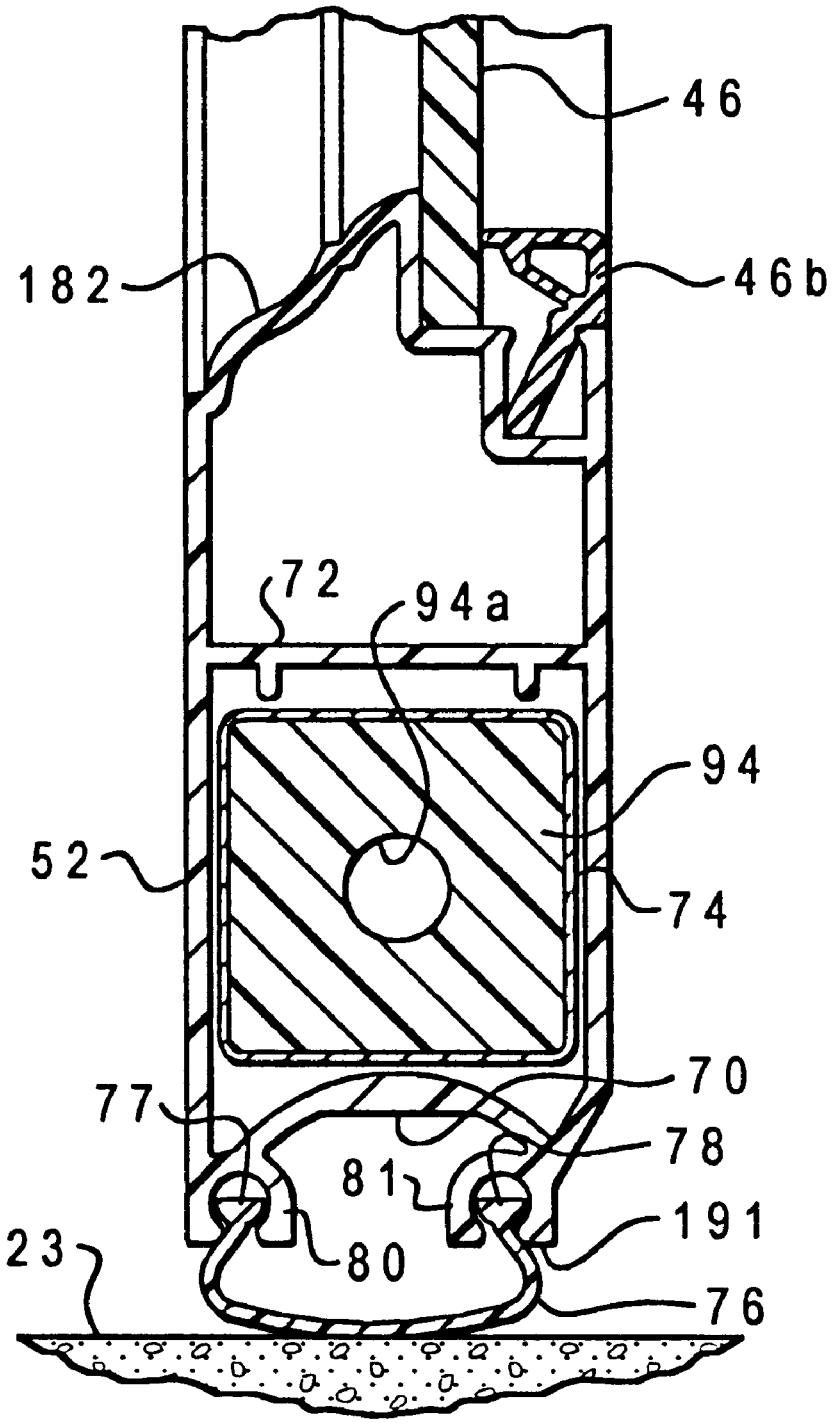
FIG. 8 is a section view taken along line 8—8 of FIG. 3.

Referring briefly to FIGS. 3, 4, and 8, the bottom rail 52 includes spaced apart sidewalls 66 and 68, FIG. 4, a longitudinal bottom wall 70 interconnecting the sidewalls 66 and 68 and at least an intermediate wall 72, FIG. 3, also interconnecting the sidewalls 66 and 68 to form a generally elongated hollow enclosure or tubular space, for receiving a longitudinally extending tubular reinforcing member 74. The reinforcing member 74 may have a generally rectangular or square cross section, for example. An elongated hollow, resilient bottom seal member 76 is connected to the bottom rail 52 by thickened distal end portions 77 and 78 of the seal member which are suitably retained in elongated socket portions 80 and 81 of the bottom rail member 52, as shown in FIG. 8.

Referring further to FIGS. 2 and 3, each lower corner of door section 20*d* supports a guide roller 62, as shown. Each guide roller 62 includes a hub portion 62*b*, which is adapted to be connected to one of the counterbalance cables 60 in a conventional manner. For example, each cable 60 may be formed to have an eye 60*b* trained around a thimble 60*c*, see FIG. 3, which is sleeved over a hub 62*b*. A support shaft 62*a* for roller 62 projects through a suitable bore formed in a bracket, generally designated by the numeral 90 in FIGS. 2 and 3. A reinforcing member 92 is disposed adjacent an end wall 42*c* of end stile 42 and may be a sheet metal member, for example. As shown in FIG. 3, bracket 90 includes a bore 91, end wall 42*c* includes a bore 42*d* and reinforcing member 92 includes a bore 92*a* for receiving the shaft 62*a*. The distal end of shaft 62*a* of each of the rollers 62 is also supported in a suitable bearing block 94 of generally rectangular cross section, see FIG. 8, which is disposed in the tubular reinforcing member 74 and is provided with a suitable bore 94*a* for receiving shaft 62*a*.

Figure 5:
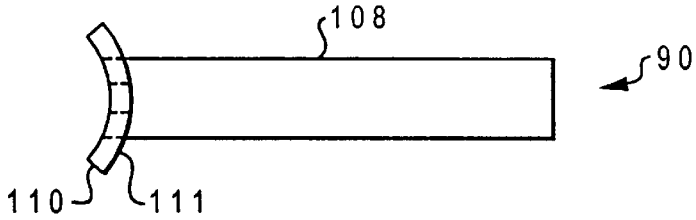
FIG. 5 is a top plan view of the bracket shown in FIGS. 2, 3 and 4.
Figure 6:
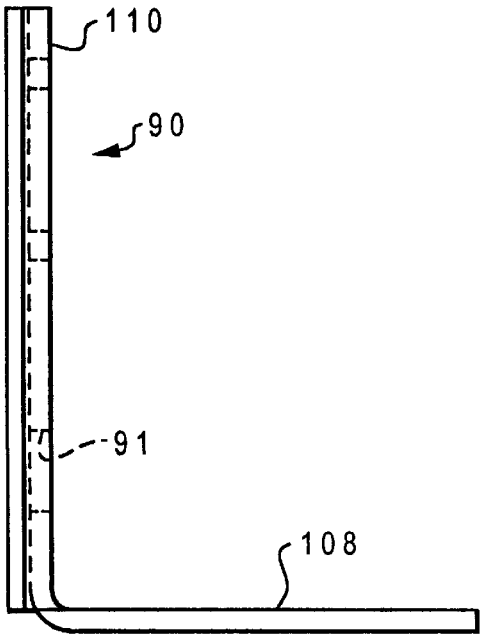
FIG. 6 is a side elevation of the bracket.
Figure 7:
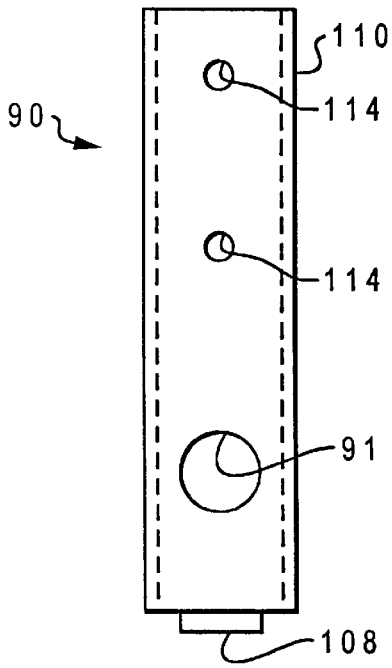
FIG. 7 is an end view of the bracket.

The bottom bracket 90 has a somewhat L-shaped configuration, see FIGS. 5 through 7 also, having a transverse bottom leg 108 operable to be engaged with the wall 70 of bottom rail 52, FIG. 3, and extending therealong from wall 42*c* of end stile 42. The bracket 90 includes an upstanding leg 110 having a somewhat arcuate cross-sectional shape, see FIGS. 4 and 5, defining a curved surface 111 engageable with concave curved wall 42*c* of end stile 42, as shown. The leg 110 of bracket 90 has at least two spaced apart fastener receiving bores 114 formed therein for receiving suitable self-tapping, panhead threaded fasteners 116 for threaded engagement with the wall 42*c* and reinforcing member 92 disposed as shown in drawing FIGS. 3 and 4. Bore 91 is also formed in leg 110 for receiving guide roller shaft 62*a* in close-fitting relationship whereby bracket 90 acts as a load-bearing member when the shaft is subject to a lateral load such as exerted by the counterbalance cable 60. Accordingly, the roller shaft 62*a* is supported by the bracket 90 and by the bearing block 94.

By placing the fasteners 116 along the bracket leg 110 in registration with the vertical end wall 42*c* of stile 42, in the position indicated in FIGS. 3 and 4, access to these fasteners for removing them while the cable 60 is under tension and the door is assembled in its tracks 24*a* and 24*b* is substantially minimized. Only when the tension in cable 60 has been purposely reduced and the door has been at least partially removed from its guide tracks can the fasteners 116 be accessed without great difficulty for removal of the bracket 90 and the cable removed from its connection with hub 62*b* of the roller assembly 62.

Moreover, the configuration of the somewhat L-shaped bracket 90 with the vertical leg 110 and the transversely extending integral leg 108 is advantageous in that an upward acting force, viewing FIG. 3, exerted by the cable 60, will cause the roller shaft 62*a* to transfer forces through the bracket 90 to the bottom edge of the door defined by the stile 42 and the bottom rail 52. Still further, the leg 108, being urged upward by the forces exerted on the bracket by the roller shaft 62*a* will also transfer forces to the bottom wall 70 of rail 52 over a relatively extended distance so that the distribution of forces acting on the opposed bottom edges of the door 20 is significant.

A bracket 90 for use with a conventional garage door 20 having a width of from about 8.0 feet to 18.0 feet may have a leg 108 approximately three inches to four inches in length while the leg 110 is also of about the same or greater length, as required to provide space for the fasteners 116 and the roller shaft receiving bore 91. In a door having conventional 7.0 foot height by 8.0 foot to 18.0 foot width, the above dimensions for a bracket formed of steel, having a thickness of about 0.13 inches are suitable. The width of the leg 110 may be on the order of about 0.87 inches and the width of the leg 108 about 0.50 inches.

The assembly, disassembly and operation of the door 20 is believed to be readily understandable to those of ordinary skill in the art from the foregoing description of the components thereof. The components not specifically described herein with regard to fabrication details and materials may be constructed using conventional materials and methods used in door manufacture. As mentioned previously, the rails 38, 40, 48 and 52, the end stiles 42 and the intermediate stiles 44 may be fabricated of extruded plastic or the like. However, these components may also be constructed in another manner.

Although a preferred embodiment of the invention has been described in detail herein, those skilled in the art will recognize that various substitutions and modifications may be made without departing from the scope and spirit of the invention as recited in the appended claims.

What is claimed is:

1. In an upward acting door forming a closure over a garage opening, spaced apart guide tracks disposed adjacent opposite sides of said door, opposed guide members engaged with respective ones of said tracks for guiding said door between open and closed positions, said door including opposed vertical side edges and a horizontally extending downwardly facing bottom edge when said door is in a closed position, a counterbalance mechanism including opposed elongated cables depending along said vertical side edges of said door, said guide members being mounted on said door adjacent said bottom edge, respectively, each of said guide members being connected directly to one of said cables for exerting a lifting force on said door through said guide members, respectively, and opposed brackets secured to said door along said vertical side edges of said door and engaged with said bottom edge of said door, respectively, each of said brackets comprising two opposed elongated leg portions extending substantially normal to each other, one of said leg portions being disposed along one of said vertical side edges and including spaced apart fastener receiving holes adjacent one of said cables for receiving fasteners for securing said bracket to said door at said vertical side edge and the other of said leg portions extending along and engaged with said bottom edge of said door, and each of said brackets includes a bore in said one leg portion for receiving a support shaft for one of said guide members, respectively, whereby said guide members are operable to exert upward lifting forces on said door through said brackets along said vertical side edges and said bottom edge, respectively.

2. The door set forth in claim 1 wherein:

each of said support shafts is disposed in bearing means mounted within said door adjacent said bottom edge.

3. The door set forth in claim 2 wherein:

each of said bearing means is disposed in a reinforcing member extending along said bottom edge of said door.

4. The door set forth in claim 1 including:

a reinforcing member disposed along each of said vertical side edges of said door and engageable with said fasteners when said fasteners are securing said brackets to said door, respectively.

5. The door set forth in claim 4 wherein:

said door includes an elongated rail member defining said bottom edge and generally vertically extending stile members defining said vertical side edges, respectively, said rail member and slid stile members being connected to each other and said rail member and said stile members being formed of a polymer material.

6. The door set forth in claim 1 wherein:

said other leg portions of said brackets extend within a hollow bottom seal member connected to said bottom edge.

7. In an upward acting door forming a closure over a garage opening, spaced apart guide tracks disposed adjacent opposite sides of said door, opposed guide members engaged with respective ones of said tracks for guiding said door between open and closed positions, said door including opposed vertical side edges and a horizontally extending downwardly facing bottom edge when said door is in a closed position, a counterbalance mechanism including opposed elongated cables depending along said vertical side edges of said door, said guide members being mounted on said door adjacent said bottom edge, respectively, each of said guide members including a support shaft, said guide members being connected directly to said counterbalance cables, respectively, for exerting a lifting force on said door through said guide members, and opposed L-shaped brackets secured to said door along said vertical side edges and engaged with said bottom edge of said door, respectively, said brackets each comprising elongated opposed leg portions, one of said leg portions being disposed along one of said vertical side edges and including spaced apart fastener receiving holes for receiving threaded fasteners for securing said brackets to said door at said vertical side edges, respectively, said fasteners being disposed between said cables and said one leg portion, respectively, when in positions of securing said brackets to said door, respectively, and said fasteners being generally inaccessible for removal from said vertical side edges when said vertical side edges are disposed between said guide tracks, respectively, and each of said brackets includes a bore in said one leg portion for receiving said support shaft for said guide member whereby said guide members are operable to exert upward lifting forces on said door through said brackets along said vertical side edges and said bottom edge, respectively.

8. The door set forth in claim 7 wherein:

each of said support shafts is disposed in bearing means mounted within said door adjacent said bottom edge.

9. The door set forth in claim 8 wherein:

each of said bearing means is disposed in a reinforcing member extending along said bottom edge of said door.

10. In an upward acting door forming a closure over a garage opening, spaced apart guide tracks disposed adjacent opposite sides of said door, opposed guide members for guiding said door between open and closed positions, said door including opposed vertical side edges and a horizontally extending downwardly facing bottom edge when said door is in a closed position, a counterbalance mechanism including opposed elongated cables depending along said vertical side edges of said door, said guide members being mounted on said door adjacent said bottom edge, respectively, each of said guide members being connected directly to one of said cables for exerting a lifting force on said door through said guide members, respectively, and opposed brackets secured to said door along said vertical side edges of said door and engaged with said bottom edge of said door, respectively, each of said brackets comprising two opposed elongated leg portions extending substantially normal to each other, one of said leg portions being disposed along one of said vertical side edges and the other of said leg portions extending along and engaged with said bottom edge of said door, spaced apart fastener receiving holes formed in said one leg portion only for receiving fasteners for securing said bracket to said door only at said vertical side edge, and each of said brackets including a bore in said one leg portion for receiving a support shaft for one of said guide members, respectively, whereby said guide members are operable to exert upward lifting forces on said door through said brackets along said vertical side edges and said bottom edge, respectively.

11. The door set forth in claim 10 wherein:

each of said support shafts is disposed in bearing means mounted within said door adjacent said bottom edge.

* * * * *